US009343280B2

(12) United States Patent
Cousins et al.

(10) Patent No.: US 9,343,280 B2
(45) Date of Patent: May 17, 2016

(54) MULTI-PRESSURE STAGE MASS SPECTROMETER AND METHODS

(75) Inventors: Lisa Cousins, Woodbridge (CA); Gholamreza Javahery, Kettleby (CA); Charles Jolliffe, Schomberg (CA); Serguei Savtchenko, Woodbridge (CA)

(73) Assignee: PerkinElmer Health Sciences Canada, Inc., Woodbridge (CA)

( * ) Notice: Subject to any disclaimer, the term of this patent is extended or adjusted under 35 U.S.C. 154(b) by 552 days.

(21) Appl. No.: 12/676,778

(22) PCT Filed: Sep. 8, 2008

(86) PCT No.: PCT/CA2008/001584

§ 371 (c)(1),
(2), (4) Date: Oct. 26, 2010

(87) PCT Pub. No.: WO2009/030048

PCT Pub. Date: Mar. 12, 2009

(65) Prior Publication Data

US 2011/0036980 A1 Feb. 17, 2011

Related U.S. Application Data

(60) Provisional application No. 60/970,804, filed on Sep. 7, 2007.

(51) Int. Cl.
*H01J 49/00* (2006.01)
*H01J 49/24* (2006.01)

(52) U.S. Cl.
CPC ..... *H01J 49/004* (2013.01); *H01J 49/24* (2013.01)

(58) Field of Classification Search
USPC ..... 250/283
See application file for complete search history.

(56) References Cited

U.S. PATENT DOCUMENTS

| | | | | |
|---|---|---|---|---|
| 5,298,743 | A * | 3/1994 | Kato | 250/288 |
| 5,381,008 | A * | 1/1995 | Tanner et al. | 250/288 |
| 5,565,679 | A | 10/1996 | Tanner et al. | |
| 6,069,355 | A | 5/2000 | Mordehai | |
| 6,528,784 | B1 | 3/2003 | Tang et al. | |
| 6,768,108 | B2 * | 7/2004 | Hirano et al. | 250/288 |
| 6,797,947 | B2 | 9/2004 | Russ, IV et al. | |

(Continued)

FOREIGN PATENT DOCUMENTS

| | | | |
|---|---|---|---|
| WO | 2005033520 | A1 | 4/2005 |
| WO | 2006000745 | A1 | 1/2006 |

(Continued)

OTHER PUBLICATIONS

Office Action for Great Britain Application No. GN1005751.1, filed Apr. 6, 2010, Great Britain Intellectual Property Office, Office Action issued Sep. 29, 2011.

(Continued)

*Primary Examiner* — Phillip A Johnston

(57) ABSTRACT

A mass spectrometer includes a plurality of guide stages for guiding ions between an ion source and an ion detector along a guide axis. Each of the guide stages is contained within one of a plurality of adjacent chambers. Pressure in each of the plurality of chambers is reduced downstream along the guide axis to guide ions along the axis. Each guide stage may further include a plurality of guide rods for producing a containment filed for containing ions about the guide axis, as they are guided to the detector.

45 Claims, 6 Drawing Sheets

(56) References Cited

U.S. PATENT DOCUMENTS

| | | | | |
|---|---|---|---|---|
| 6,956,205 | B2 | 10/2005 | Park | |
| 6,987,264 | B1 * | 1/2006 | Whitehouse | H01J 49/004 250/292 |
| 7,009,176 | B2 | 3/2006 | Thakur | |
| 7,034,292 | B1 | 4/2006 | Whitehouse et al. | |
| 7,091,477 | B2 * | 8/2006 | Jolliffe | H01J 49/0468 250/281 |
| 7,256,395 | B2 * | 8/2007 | Collings et al. | 250/288 |
| 2003/0062474 | A1 * | 4/2003 | Baranov | H01J 49/044 250/288 |
| 2004/0217280 | A1 * | 11/2004 | Schneider | H01J 49/06 250/288 |
| 2007/0148020 | A1 | 6/2007 | McCauley | |

FOREIGN PATENT DOCUMENTS

| | | | |
|---|---|---|---|
| WO | 2006048602 | A2 | 5/2006 |
| WO | 2008104314 | A1 | 9/2008 |
| WO | 2008151968 | A2 | 12/2008 |

OTHER PUBLICATIONS

International Search Report for International Application No. PCT/CA2008/001584, dated Nov. 19, 2008.

Great Britain Intellectual Property Office, "Office Action" issued Jul. 31, 2012, in related Great Britain Application No. GN1211549.9, filed Apr. 6, 2010.

Huang et al., "Atmospheric Pressure Ionization Mass Spectrometry Detection for the Separation Sciences," Analytical Chemistry, vol. 62, No. 13, Jul. 1, 1999, pp. 713A-725A.

* cited by examiner

MULTI-PRESSURE STAGE MASS SPECTROMETER AND METHODS

CROSS-REFERENCE TO RELATED APPLICATIONS

This application is a national filing of International Application No. PCT/CA2008/001584, filed on Sep. 8, 2008, entitled "MULTI-PRESSURE STAGE MASS SPECTROMETER AND METHODS", which claims priority from U.S. Provisional Patent application No. 60/970,804, filed Sep. 7, 2007, the contents of which are hereby incorporated herein by reference.

FIELD OF THE INVENTION

The present invention relates generally to mass spectrometers, and more particularly to mass spectrometers having multiple pressure stages, and related methods.

BACKGROUND OF THE INVENTION

Mass spectrometry has proven to be an effective analytical technique for identifying unknown compounds and determining the precise mass of known compounds. Advantageously, compounds can be detected or analyzed in minute quantities allowing compounds to be identified at very low concentrations in chemically complex mixtures. Not surprisingly, mass spectrometry has found practical application in medicine, pharmacology, food sciences, semi-conductor manufacturing, environmental sciences, security, and many other fields.

A typical mass spectrometer includes an ion source that ionizes particles of interest. The ions are passed to an analyser region, where they are separated according to their mass (m)-to-charge (z) ratios (m/z). The separated ions are detected at a detector. A signal from the detector is provided to a computing or similar device where the m/z ratios are stored together with their relative abundance for presentation in the format of a m/z spectrum.

Typical ion sources are exemplified in "Ionization Methods in Organic Mass Spectrometry", Alison E. Ashcroft, The Royal Society of Chemistry, UK, 1997; and the references cited therein. Conventional ion sources may create ions by atmospheric pressure chemical ionisation (APCI); chemical ionisation (CI); electron impact (EI); electrospray ionisation (ESI); fast atom bombardment (FAB); field desorption/field ionisation (FD/FI); matrix assisted laser desorption ionisation (MALDI); or thermospray ionization (TSP).

Ionized particles may be separated by quadrupoles, time-of-flight (TOF) analysers, magnetic sectors, Fourier transform and ion traps.

The ability to analyse minute quantities requires high sensitivity. High sensitivity is obtained by high transmission of analyte ions in the mass spectrometer, and low transmission of non-analyte ions and particles, known as chemical background.

Many known mass spectrometers produce ionized particles at high pressure, and require multiple stages of pumping with multiple pressure regions in order to reduce the pressure of the analyser region in a cost-effective manner. Vacuum pumps and multiple pumping stages reduce the pressure in a cost-effective way, decreasing the gas load along various pressure stages.

Because most useful ion sources operate at high pressure, and most useful mass spectrometers operate at lower pressure, ions must be transported from regions of higher pressure to lower pressure. Conventionally, an associated ion guide transports ions through these various pressure regions. An ion guide guides ionized particles between the ion source and the analyser/detector. The primary role of the ion guide is to transport the ions toward the low pressure analyser region of the spectrometer. For high sensitivity low ion losses at each stage are desirable.

At the same time, the sensitivity of the mass spectrometer depends at least in part on the inlet orifice from atmosphere. However larger orifice diameters put more gas load on the system. Often the ion guide includes several such stages of accepting and emitting the ions, as the beam is transported through various vacuum regions and into the analyser. Conventional mass spectrometers utilize large differential pressure drops from stage to stage, for example typically 100-1000 fold, in order to remove the gas load quickly, in an attempt to focus the ion beam in an ion guide.

Unfortunately this approach causes a reduction in sensitivity due to scattering losses that occur at the transition points from stage to stage. For example, as the ion and gas exit a high pressure region into a lower pressure region, the ion beam may be entrained in a flow of high density gas. The ions in the high density gas cannot be readily guided or concentrated. Ions may be scattered in the high density gas, and lost to the surroundings.

Accordingly, there is a need for an improved mass spectrometer, including multiple pressure stages that may provide for smoother transport of ions from a high pressure region to a lower pressure region.

SUMMARY OF THE INVENTION

In accordance with an aspect of the present invention, there is provided a mass spectrometer. The mass spectrometer comprises: a plurality of guide stages for guiding ions between an ion source and an ion detector along a guide axis; an ion interface providing ions from an ion source to a first one of the plurality of guide stages; each of the guide stages contained within one of a plurality of adjacent chambers; at least one pump in flow communication with the plurality of chambers to maintain the pressure therein; wherein pressure in each of the plurality of chambers is reduced downstream along the guide axis, and the pressure at an outlet of the ion interface differs from the pressure of the first one of the plurality of chambers by about an order of magnitude, and the pressure of the first one of the plurality of chambers differs from the pressure of the second one of the plurality of chambers by about an order of magnitude.

In accordance with another aspect of the present invention, there is provided a method guiding ions between an ion source and an ion detector along a guide axis in a mass spectrometer. The method comprises: providing a plurality of guide stages, each contained within one of a plurality of adjacent chambers arranged about the guide axis, and in flow communication with each other; providing an ion interface providing ions from an ion source to a first one of the plurality of guide stages; maintaining pressure in each of the plurality of chambers and the ion interface, so that the pressure along the guide axis from the ion source to the ion detector is reduced from guide stage to guide stage, and the pressure at an outlet of the ion interface differs from the pressure of the first one of the plurality of chambers by about an order of magnitude, and the pressure of the first one of the plurality of chambers differs from the pressure of the second one of the plurality of chambers by about an order of magnitude, to smoothly guide ions along the axis.

In accordance with yet another aspect of the present invention, there is provided a mass spectrometer, comprising: a plurality of guide stages for guiding ions between an ion source and an ion detector along a guide axis; an ion interface having a gas inlet and an outlet providing ions to a first one of the guide stages; each of the guide stages contained within one of a plurality of adjacent chambers, wherein pressure in each of the plurality of chambers is reduced downstream along the guide axis, at least one pump stage, in flow communication with at least one of the plurality of chambers to maintain the pressure therein, wherein ion flow through the ion interface is regulated by the at least one pump stage, through the outlet of the ion interface, and wherein all gas through the gas inlet passes through the outlet of the ion interface.

In accordance with yet another aspect of the present invention, there is provided an ion interface, comprising a single gas inlet for receiving a transport gas and ions to be passed to a downstream stage of a mass spectrometer, and a single gas outlet, to be place in flow communication with the downstream stage of the mass spectrometer, wherein ion flow through the ion interface is regulated by, through the outlet, and wherein all gas through the gas inlet passes through the outlet of the ion interface.

In accordance with yet another aspect of the present invention, there is provided a mass spectrometer, comprising: a plurality of guide stages for guiding ions between an ion source and an ion detector along a guide axis; each of the guide stages contained within one of a plurality of adjacent chambers, wherein pressure in each of the plurality of chambers is reduced downstream along the guide axis; at least one pump in flow communication with at least one of the plurality of chambers to maintain the pressure therein, wherein the number of the guide stages exceeds the number of said pumps.

In accordance with yet another aspect of the present invention, there is provided a mass spectrometer, comprising: at least four guide stages for guiding ions between an ion source and an ion detector along a guide axis, each of the guide stages contained within one of a plurality of chambers; at least one pump in flow communication with at least one of the plurality of chambers to maintain the pressure therein; wherein pressure within the four chambers is maintained, at about at least one Torr; several hundred milliTorr; at least one Millitor; and at least one micro-Torr. along the guide axis.

In accordance with yet another aspect of the present invention, there is provided a mass spectrometer, comprising: at least three guide stages for guiding ions between an ion source and an ion detector along a guide axis; each of the at least three guide stages contained within one of a plurality of adjacent chambers, wherein pressure in each of the plurality of chambers is reduced downstream along the guide axis, and wherein the pressure difference between a first and final one of the at least three stages exceeds seven orders of magnitude, and wherein the pressure difference between any two adjacent ones of the at least three stages does not exceed two orders of magnitude.

In accordance with yet another aspect of the present invention, there is provided a mass spectrometer, comprising: a plurality of guide stages for guiding ions between an ion source and an ion detector along a guide axis; each of the guide stages contained within one of a plurality of adjacent chambers; at least one pump in flow communication with the plurality of chambers to maintain the pressure therein; wherein pressure in each of the plurality of chambers is reduced downstream along the guide axis, and wherein two adjacent ones of the plurality of chambers are interconnected by a opening, and wherein the at least one pump is in direct flow communication with the downstream one of the two adjacent chambers, and not the upstream one of the two adjacent chambers, and wherein the opening and the at least one pump are sized to establish a desired pressure in both said two adjacent one of the chambers.

Conveniently, pressure in the multiple stages may be provided by a reduced number of pumps. A single pump may act as a pump stage, for multiple guide stages.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate by way of example only, embodiments of the present invention.

DETAILED DESCRIPTION

Figure 1:
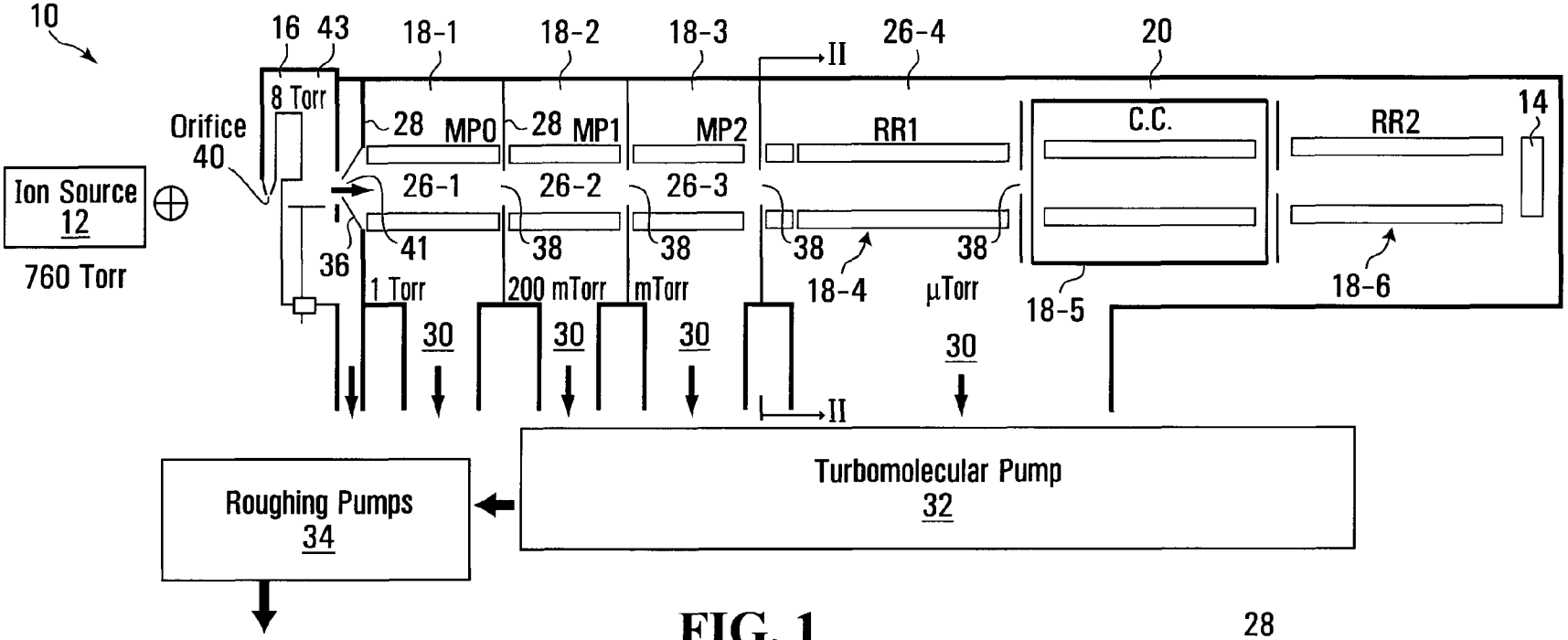
FIG. 1 is a schematic diagram of a mass spectrometer, exemplary of an embodiment of the present invention.

FIG. 1 illustrates a mass spectrometer 10, exemplary of an embodiment of the present invention. As will become apparent, mass spectrometer 10 includes multiple guide stages at various pressures, in order to smoothly guide ions from a high pressure ion source 12 to a detector 14.

As illustrated, mass spectrometer 10 includes an ion source 12, providing ions to a mass spectrometer interface 16 in communication with a plurality of ion guide stages 18-1, 18-2, 18-3, 18-4, 18-5 and 18-6 (individually, and collectively guide stages 18) formed in a generally cylindrical housing 20.

In the depicted embodiment, each guide stage 18 includes a plurality of guide rods 22 arranged about a guide axis 24. Typically, a set of guide rods 22 is located at a fixed radial distance from guide axis 24, within each stage 18. Guide rods 22 may, for example, be arranged in quadrupole, octupole, hexapole or the like. One or more voltage sources (not shown) allow(s) generation of a containment field, by guide rods 22, within each stage 18. Again, the field may be quadrupolar, octupolar, hexapolar, or the like. The distance of rods from axis 24 may be different for each stage 18. Each set of guide rods 22 within a stage 18 may act as a guide, mass filter, collision cell, mass resolver, or the like. Other ion guides, including ion funnels, stacked lenses, and the like, known to those of ordinary skill may be used.

Optionally, each stage 18 may include additional components. For example, a guide stage 18 acting as a collision cell may be contained in its own housing (within cylindrical housing 20). Guide stages may include focusing lenses, and the like.

In the example embodiment of FIG. 1, mass spectrometer 10, includes six guide stages 18. However, a person of ordinary skill will readily appreciate that an exemplary mass spectrometer could include an arbitrary number of guide stages.

Notably, at least some of guide stages 18 are formed within an individual pressure chamber 26-1, 26-2, 26-3 . . . (individually and collectively chamber(s) 26). Example chambers 26 may be formed from an outer wall, such as a portion of outer wall of housing 20 and at least one dividing wall 28.

Dividing wall 28 may create a chamber that is partially insulated from an adjacent chamber. Dividing wall 28 may take the form of annular wall, having a generally circular opening 38 providing flow communication from guide stage to guide stage 18. In the depicted non-limiting embodiment, the primary direct communication between adjacent chambers 26 is through opening 38 of dividing wall 28. Conveniently, opening 38 of each dividing wall 28 may coincide with the radial distance between axis 24 and the edge of rods 22 in each stage 18.

Figure 2:
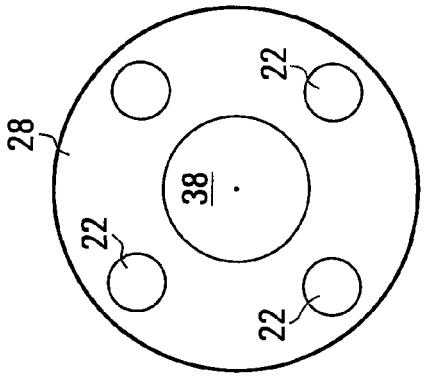
FIG. 2 is a schematic cross-sectional view of the mass spectrometer of FIG. 1 along lines II-II.

A schematic cross-sectional view of mass spectrometer 10, at line II-II is depicted in FIG. 2. Rods 22, although not actually visible in cross-section (as their visibility is obstructed by wall 28) are depicted in shadow.

Additionally, each chamber 26 may include a pressure or air exit 30 in flow communication with a pump 32 (or pump 34), as illustrated in FIG. 1. Each exit 30 may provide a fluid exit in a direction generally normal to guide axis 24. Each pressure exit 30 may be in communication with a pump 32/pump 34 or a pump stage of pump 32/pump 34 to provide a controlled pressure within an associated chamber 26.

Interface 16 may provide an initial guide for sampled ions, and may thus also be considered a guide stage of mass spectrometer 10. A suitable interface is for example described in U.S. Pat. No. 7,091,477, the contents of which are hereby incorporated by reference. The depicted interface 16 is a split flow interface and includes a casing defining a chamber 43 having a sampling inlet 40 in communication with ion source 12, typically held near atmosphere, and an outlet 41 in communication with the first stage 18-1 of stages 18. As disclosed in the '477 patent, interface 16 may slow the flow gas and ions to become generally laminar. The ion and neutral gas flow may be sampled from the laminar flow region of interface 16 and provided to downstream stages of mass spectrometer 10. Interface 16 includes a further outlet in communication with pump 32. A transport gas thus flows from inlet 40 to pump 32. Ions entrained in gas are sampled from the flow by cone 36, into stage 18-1.

In the depicted embodiment, the pressure drop from chamber 43 to chamber 26-1 and from chamber 26 to chamber 26 is controlled to limit the pressure gradient between chambers 26. That is, the pressure drop from chamber 26-1 to chamber 26-2 is less than a prescribed maximum, reducing the force associated with radial diffusion of the flow of transport gas, thus improving ion transfer and reducing losses from chamber to chamber. In a particular embodiment, pressure drop from chamber to chamber 43 to chamber 26-1 and from chamber 26-1 to chamber 26-2 is about an order of magnitude. Of course, pressure drop from chamber to chamber 26 could vary by more than an order of magnitude.

The pressure within ion interface 16 varies at various locations within interface 16. For example, the pressure near the outlet of interface in communication with chamber 26-1 is about 8 Torr. The pressure within each chamber 26 is generally constant within that chamber 26. As illustrated, the pressure within chamber 26-1 (stage 18-1) in maintained at about 1 Torr, within chamber 26-2, 200 millitorr (stage 18-2); within chamber 26-3 (stage 18-3), about 1 mTorr; and within chambers 26-4 (stage 18-4, 18-5 and 18-6) about 1 uTorr. As such, mass spectrometer 10 includes five pressure regions.

Typically, the exact pressure within each chamber 26 is a function of the speed and pressure of pump 32/or pump 34 (or the pump stage), the size of the orifices (e.g. exit 30) providing flow communication with pump 32 to chamber 26, the inlet size (e.g. hole 38), and the outlet size (i.e. hole 38). Thus, appropriate choices of speed of pumps 32, 34 and orifice sizes in communication with the pumps to each chamber 26 may be chosen to provide desired pressures. Additionally, the net flow through chambers 26 is governed by the flow into sampling inlet 40

In the depicted embodiment, a single pump 32 evacuates chambers 26-2, 26-3 and 26-4 through exit 30 to provide the controlled pressure differential. More specifically, pump 32 may be a turbo-molecular pump, having multiple pressure inlet stages. Mass spectrometer interface 16 is further in communication with one or more roughing pumps 34 to provide air to evacuation in interface 16, and chamber 26-1. Roughing pump 34 may also accept the exhaust of pump 32. A separate roughing pump 34 and turbomolecular pumps are used in the depicted embodiment, in order to produce desired flow rates to produce a full range of pressures/flow rates in chambers 26.

More specifically, pressure within each chamber may be approximated by:

$$\text{Pressure}=\text{Throughput}/\text{Pump speed} \quad (1).$$

For example ions in FIG. 1, are first sampled by inlet 40 near atmospheric pressure, thus defining initial gas throughput into interface 16, in combination with roughing pump 34. For example, inlet 40 may be 800 u and roughing pump 34 may pump 30-40 $m^3$/hr, yielding a pressure near cone 36 of about 8 Torr. Ions and gas are then sampled in chamber 26-1 through cone 36 with an aperture/opening 38 sized to provide a pressure of about several Torr (for example 1-3 Torr) using a second stage of roughing pump 34. Opening 38 leading from chamber 26-1 to chamber 26-2 may be selected to provide a pressure near 200 mTorr using a drag stage of pump 32 having pump speed of about 30 l/s. A next chamber 26-3 may be held at about 1 mTorr (e.g. 1 to 10 mTorr) using the first high vacuum stage pumping about 400 l/s at 1 mTorr and proper selection of next opening 38. Finally, chamber 26-4 may be held below 0.1 mTorr (e.g. 1-10 uTorr) using a second high vacuum stage of pump 34 pumping near 500 l/s and proper selection of next aperture 38.

For example, pump 32 may be an multiple stage turbomolecular pump, such as that provided by Pfeiffer model TMH 521-400-30. Roughing pump 34 may provide roughly 30-40 $m^3$/hr pump speed over the range of 1 to 10 Torr, and may for example be an Sogevac SV40 roughing pump available from Leybold.

If available, a single pump producing pressures/flows equivalent to both pump 32 and 34 could be used. Similarly, more than two pumps could be used. Conveniently, use of two pumps (having multiple stages) may reduce costs.

As will be appreciated, not each stage 18 need be in direct fluid communication with a pump—like pump 32 or 34. Instead, flow through from chamber 26 to chamber 26 may indirectly control the pressure in a chamber that is not in direct fluid communication with a pump, like pump 32 or 34. Pressure may be controlled through appropriately sized openings 38. Optionally additional openings not directly on the guide axis 24 may provide required flow between adjacent chambers 26 to regulate pressure within the chamber, as desired. As will be appreciated, as the pressure within any chamber 26 is influenced by the flow rate/pressure of immediately adjacent chambers, and the flow rate to an interconnected pump, a great number of variations of pump pressure, and openings 38 may be used to achieve a desired pressure within a particular chamber. For example, pressure in chamber 26-3 could be maintained at 200 mTorr by sealing exit 30, and adjusting the size of outlet 38 of chamber 26-2 and the size of outlet 38 of chamber 26-3 to chamber 26-4, to achieve the desired pressure within chamber 26-3.

Finally, a sampling cone 36 provides flow communication between ion interface 16 and the initial guide stage 18-1. Cone 36 may be at least semi-conductive and may be frustoconical, elongate, tubular, or the like.

Cone 36 may further include a diffuser, as described in E. M. Greitzer, C. S, Tan and M. B. Graf, Internal Flow Concepts and Applications, Cambridge University Press 2004, for example.

In operation, ion source 12 provides ions at about atmospheric pressure (e.g. 760 Torr). Ions are sampled by mass spectrometer interface 16. Roughing pump 34 evacuates interface 16, and produces a pressure of about 8 Torr within chamber 43 of interface 16, near its outlet 41 to chamber 26-1. Interface 16 may be further be heated. Cone 36 samples or skims ions and transmits these to the inlet of guide stage 18-1. Sampled ions are thus provided to the initial mass spectrometer stage 18-1. Within mass spectrometry stage 18-1 pressure is maintained at about 1 Torr. Ions are guided between rods 22 of guide stage 18-1. More specifically, an electric field is applied to rods 22 to contain ions between the rods and optionally guide these axially towards the exit of guide stage 18-1, through wall 28 at the exit of chamber 26-1 containing stage 18-1. Ions are thus guided from stage 18-1 to 18-2.

Pressure within each chamber 26 is less than the pressure within previous upstream chamber 26 further aiding the guide of ions from stage to stage 18. Likewise, an alternating electric containment field between rods 22 of each stage 18 guides ions within each guide stage 18. This field, as well as the pressure differential between adjacent stages 18, may guide the ions from guide stage to guide stage 18. Each stage 18 may further filter, focus, resolve or collide ions within the stage.

Conveniently, the pressure differential from stage to stage 18 for at least some stages 18 is controlled, as stages are isolated from upstream stages in adjacent chambers 26. Openings 38, exit 30 and pump 32 may be appropriately sized, as described above, to achieve the desired pressures. In this way, the controlled pressure air allows for a smooth, relatively non-abrupt, pressure gradient from chamber 26-1 to 26-2 to 26-3 and so on. This in turn, aids in the guidance of ions from stage 18-1 to 18-2, reducing losses from chamber to chamber and improving ion transfer. Once ions have been guided to the final stage of mass spectrometer 10, ions of any specified mass to charge ratio may be detected at detector 14 in a conventional manner.

Conveniently, a single, multi-stage pump 32 (and optionally a roughing pump 34) may provide the required pressures differential between many chambers 26. As will be appreciated, use of a reduced number of pumps, and in particular a single pump may significantly reduce the cost, size and complexity of mass spectrometer 10.

As will be appreciated, the mass spectrometer of FIGS. 1 and 2 may be modified in a number of ways. For example, the number of stages 18 may vary from the depicted four stages. For example, three, five, six or more stages may form part of spectrometer 10. The depicted pressures are similarly only exemplary. Similarly, rods 22 are depicted as contained within a stage 18. However, rods 22 may extend lengthwise through two or more stages 18. In an alternate embodiment, a single set of rods 22 may extend lengthwise through all stages 18.

Figure 3:
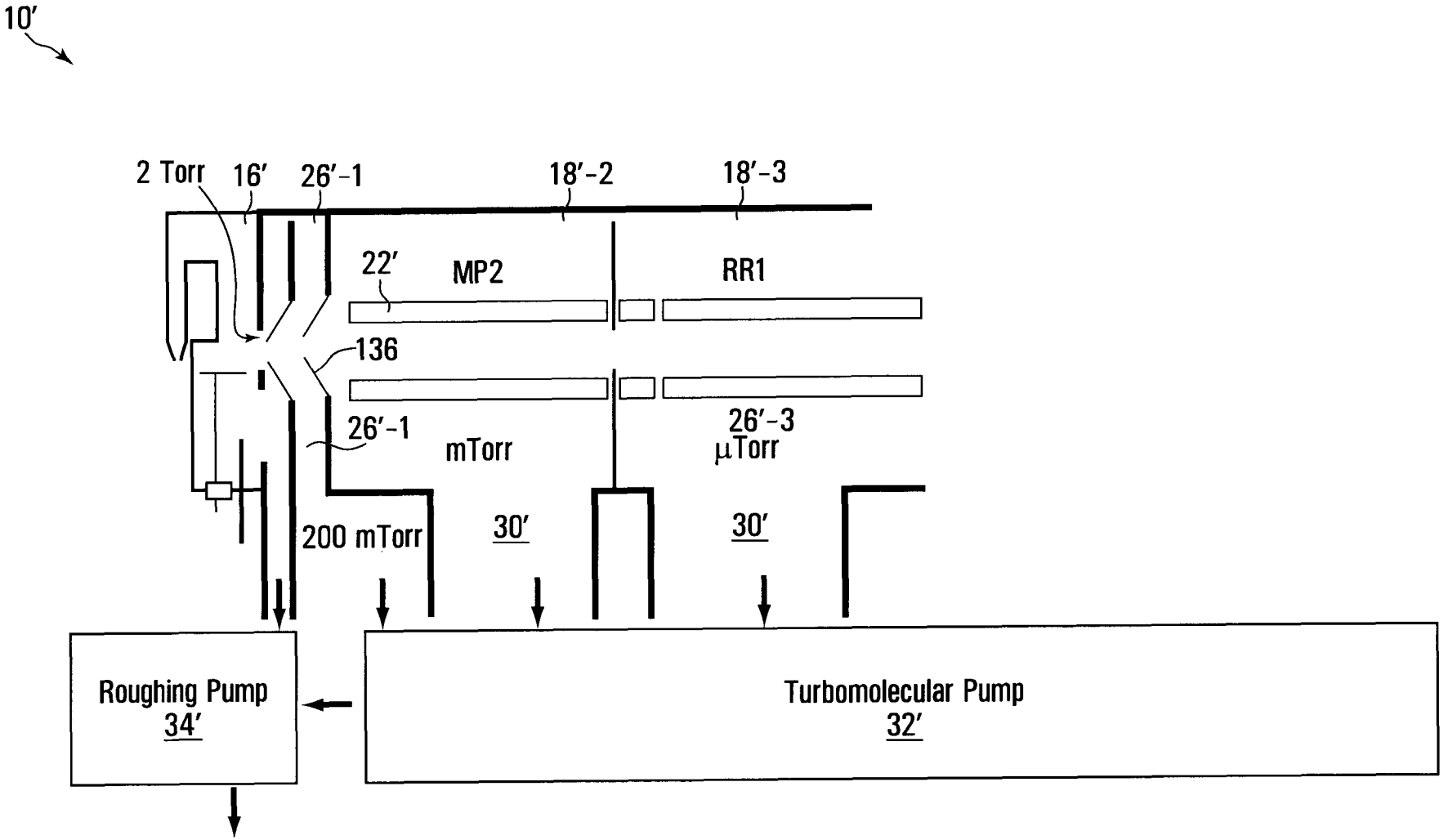
FIG. 3 is a partial schematic diagram of a mass spectrometer, exemplary of another embodiment of the present invention.

In a further alternate embodiment, as for example illustrated in FIG. 3, an example mass spectrometer 10' may include mass spectrometry stages 18' that do no not include any rods 22 (FIG. 1). For ease of description, components of mass spectrometer 10' that are similar to those of mass spectrometer 10 (FIG. 1) will not be specifically described, and instead numbered as in FIG. 1, with a single prime (') symbol. As well, only the first three stages 18' are depicted.

As illustrated, mass spectrometry stage 18'-1 of mass spectrometer 10' may simply be formed by a sampling cone 136 (like cone 36—FIG. 1) isolated in a chamber 26'-1 in flow communication with a pressure source producing the desired pressure within the chamber 26'. Thus, as depicted in FIG. 3, a first mass spectrometry stage 18'-1 does not include guide rods. Instead, cone 136 is used to sample ions into stage 18'-1. These ions are provided further downstream to stage 18'-2.

Again, pressure within each stage 18' (including stage 18'-1) may be controlled by a pump 32' in communication with a pressure exit 30' of each stage 18'. As will be appreciated, a stage, such as stage 18'-1 could include multiple sampling cones. Alternatively, multiple stages 18' could each include one or more sampling cones, like cone 136, in place of guide rods.

In the embodiment of FIG. 3, pump 32 may evacuate chamber 26'-1, while pump 34' may evacuate interface 16' to produce pressures of 2 Torr near the exit of interface 16' and 200 mTorr in chamber 26-1.

Figure 4:
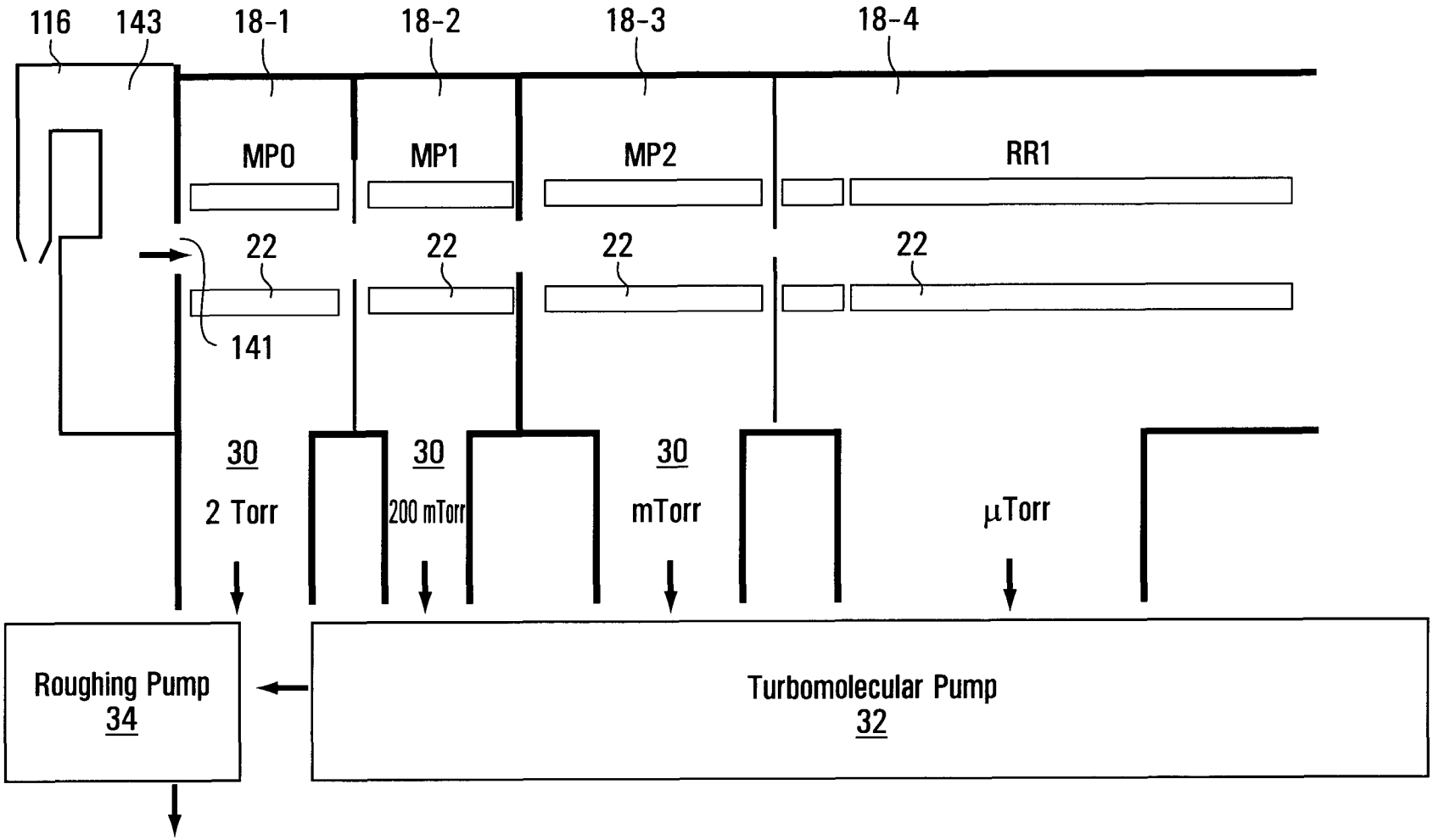
FIG. 4 is a partial schematic diagram of a mass spectrometer, exemplary of yet another embodiment of the present invention.

In yet other embodiments depicted in FIG. 4 spectrometer interface 16 may be replaced with a thru-flow interface 116 in place of split flow interface 16 of FIGS. 1 and 3. Thru-flow interface 116 includes a chamber 143, having only a single outlet 141, to a downstream stage 18-1. As such, all ions (and gas) entering interface 116 will exit to downstream guide stage 18-1, through the provided outlet 141. As such, flows and pressure in interface 116 may be more easily adjusted, to yield a smooth, non-abrupt pressure drop. Roughing pump(s) 34 thus only evacuates chamber 26-1 (containing stage 18-1), thereby reducing the pumping cost of the mass spectrometer. For example, stages 18-1 through 18-3 can be configured to yield 2 Torr, 200 mTorr and 1-10 mTorr, respectively. Pressure in interface 116 can be adjusted to yield a pressure gradient of about an order of magnitude between outlet 141 and the entrance to guide stage 18-1 entrance. The pressure at outlet 141 may for example be between 10-20 Torr.

In further alternate embodiments, the number of pump stages providing differing flows may be reduced. Possibly, a pump having only a single pump pressure stage may be used. To this end, FIGS. 5 and 6 illustrate two further mass spectrometers 200 and 200', exemplary of further embodiments of the present invention.

Mass spectrometer 200 includes multiple stages 218-1, 218-2 . . . (like stages 18—FIG. 1). Each stage is contained within a chamber 226-1, 226-2 . . . (like chambers 26—FIG. 1) in casing 220. Each chamber 226 includes one or more conductance limiting orifices 250, in flow communication with a pressure pump 232 (or pump 234). Pump 232 (and pump 234) provide(s) a defined flow from the exterior of the multiple chambers 226. However, the net size of conductance limiting orifices 250 to each chamber governs the pressure in the interior of each chamber.

Figure 5:
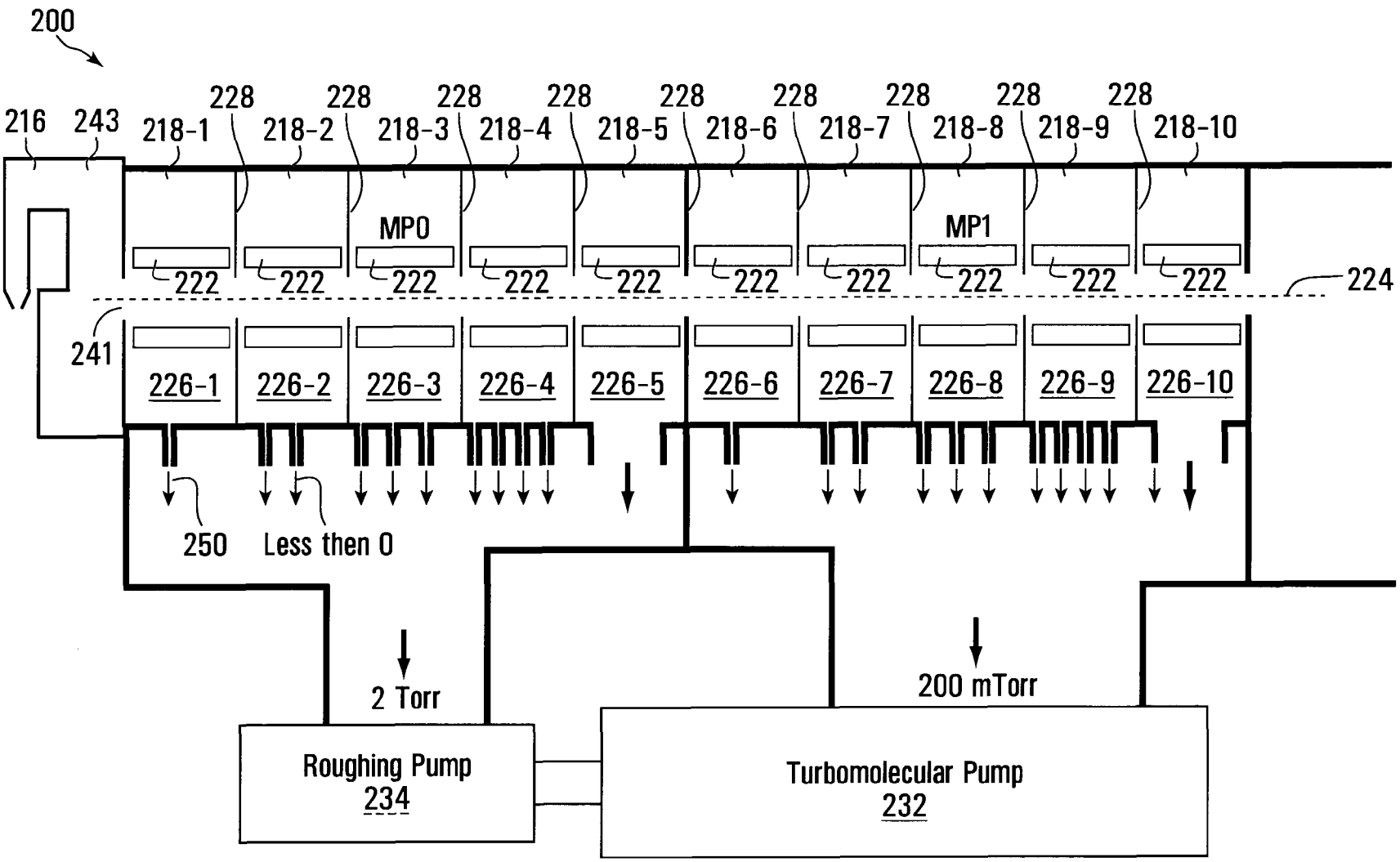
FIG. 5 is a schematic diagram of a mass spectrometer, exemplary of another embodiment of the present invention.
Figure 6:
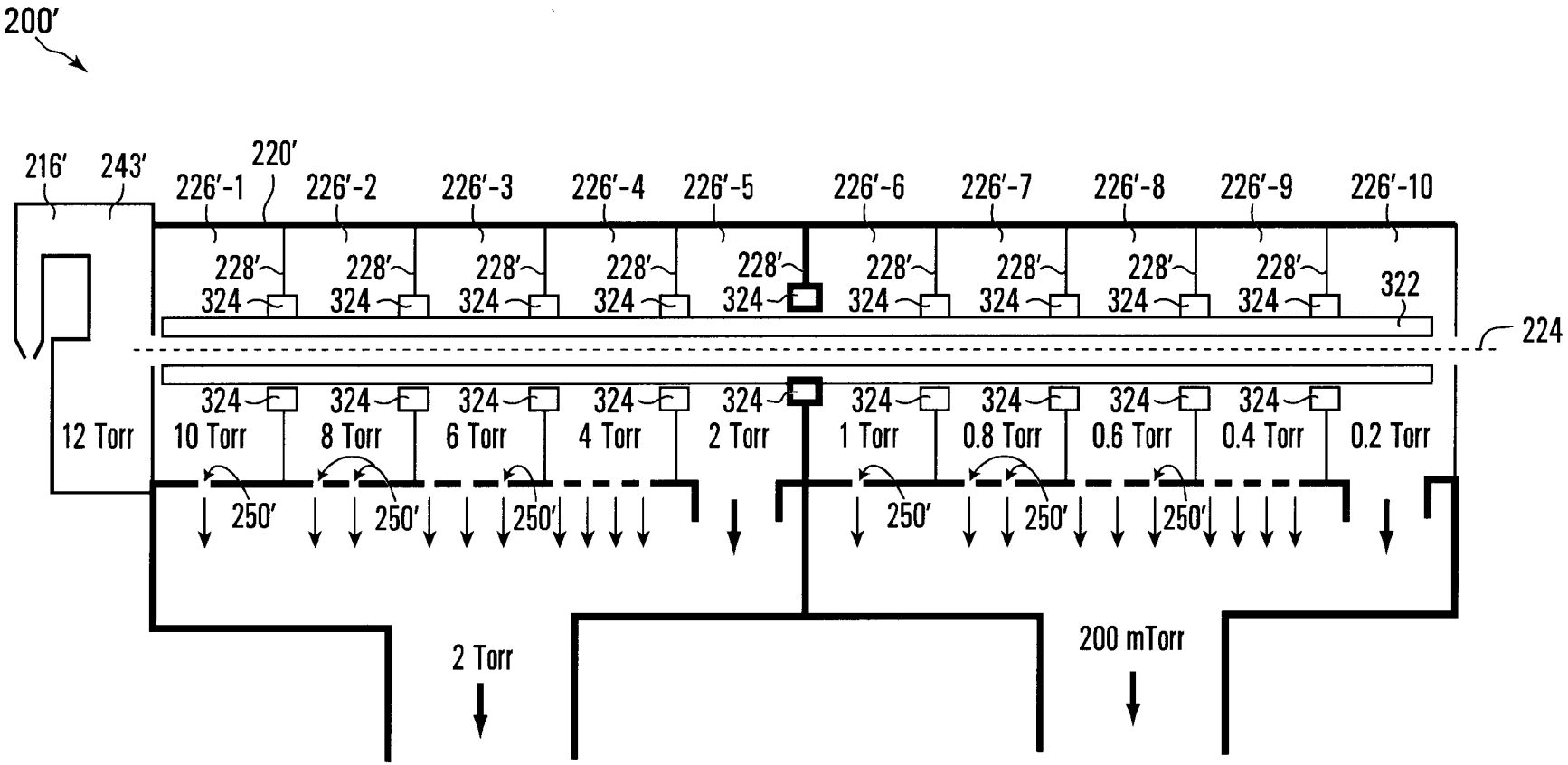
FIG. 6 is a schematic diagram of a mass spectrometer, exemplary of a further embodiment of the present invention.

In the embodiment of FIG. 5, a roughing pump 234 is used to evacuate chambers 226-1, 226-2, 226-3, 226-4, and 226-5. Various conductance limiting orifices 250 (formed as orifices in an outer wall of associated chambers 226) provide flow communication between the interior of chambers 226-1, 226-2, 226-3, 226-4 and 226-5 and pump 234, cause the pressures within chamber 226-1, 226-2, 226-3, 226-4, and 226-5 to be 10 Torr, 8 Torr, 4 Torr and 2 Torr, as a consequence of a single pump providing a 2 Torr vacuum pressure. Similarly, chambers 226-6, 226-7, 226-8, 226-9 and 226-10 are in flow communication with a pump 234, providing a 200 mTorr vacuum pressure. Again, conductance limiting orifices 250, allow for the creation of pressures of 1 Torr, 0.8 Torr, 0.6 Torr, 0.4 Torr and 0.2 Torr in theses chambers 226-6, 226-7, 226-8, 226-9 and 226-10. In this way, pumping costs can again be reduced.

The net size of orifices 250 may be determined analytically or empirically to establish desired pressures. For example, the relationship $$\text{Pump speed(current stage)}=[1/\text{conductance}+1/\text{pump speed(previous stage)}]-1 \quad (2)$$

may be used to calculate required orifice sizes.

The, conductance through each orifice 250, in turn depends on pressure ratio and is proportional to nvA where n is number density, v is velocity and A is area of the orifice, and may be estimated as 20×A l/s where A is $cm^2$, with more precise estimates taking into account the Knudsen number, the pressure drop, the thickness of the orifice, and other parameters (e.g. geometry including length, shape, etc.) as is commonly known in pumping technology.

Again, a thru-flow ion interface 216 having a chamber 243 with outlet 241 provides ions from an ion source (not shown) into the initial guide stage 218-1. Ion interface 216 may be maintained at 12 Torr by pump 234, and appropriately sized orifice 250, and outlet 241. As will be appreciated, the pressure through interface thru-flow ion interface 216 (and likewise interface 116) may be approximated using equations (1) and (2), above.

Chambers 226 containing stages 218 are separated by annular walls 228 (like wall 28—FIG. 2). Rods 222 (like rods 22) in each stage are arranged about a guide axis 224 may provide a field for containment and guiding of ions within each stage, and to an adjacent downstream stage. Rods 222 may likewise be arranged in quadrupole, hexapole, octopole, or the like. A suitable AC containment field may contain ions between the rods of each stage 218, to guide ions along axis 224. Rods 222 for each stage may again be arranged at different radial distances from axis 224.

Once again, the gradual pressure gradient, formed as a result of controlled pressure difference from chamber to chamber 226 allow for the smooth guiding of ions along axis 224 and stages 218, thereby reducing losses.

FIG. 6 schematically depicts a further mass spectrometer 200', exemplary of an embodiment of the present invention. For ease of description, components of mass spectrometer 200' that are similar to those of mass spectrometer 200 (FIG. 5) will not be specifically described, and instead numbered as in FIG. 1, with a single prime (') symbol. Again, in the embodiment of FIG. 6, a roughing pump 234' is used to evacuate chambers 226'-1, 226'-2, 226'-3, 226'-4, and 226'-5. Various sized conductance limiting orifices 250' provide flow communication between the interior of chambers 226'-1, 226'-2, 226'-3, 226'-4 and 226'-5 and a pump (not shown), cause the pressures within chamber 226'-1, 226'-2, 226'-3, 226'-4, and 226'-5 to be 10 Torr, 8 Torr, 4 Torr and 2 Torr, as a consequence of a single pump (not shown) providing a 2 Torr vacuum. Similarly, chambers 226'-1, 226-2, 226-3, 226-4 and 226-5 are in flow communication with a pump (not shown) providing a 200 mTorr vacuum.

A single set of rod 322 extends lengthwise throughout all stages 218', about a guide axis 224. Again, set of rods 322 may include four, six, eight, ten or more rods, arranged in quadrupole, hexapole, etc. Rods 322 may be suspended by walls 228, and isolated therefrom by insulating spacers 324.

A voltage source (not shown) produces a suitable containment field to contain ions from an ion source between rods 322. Again, the pressure gradient from stage to stage 218' in combination with the generated field between rods 322 may guide ions from stage to stage, along axis 224'.

Figure 7:
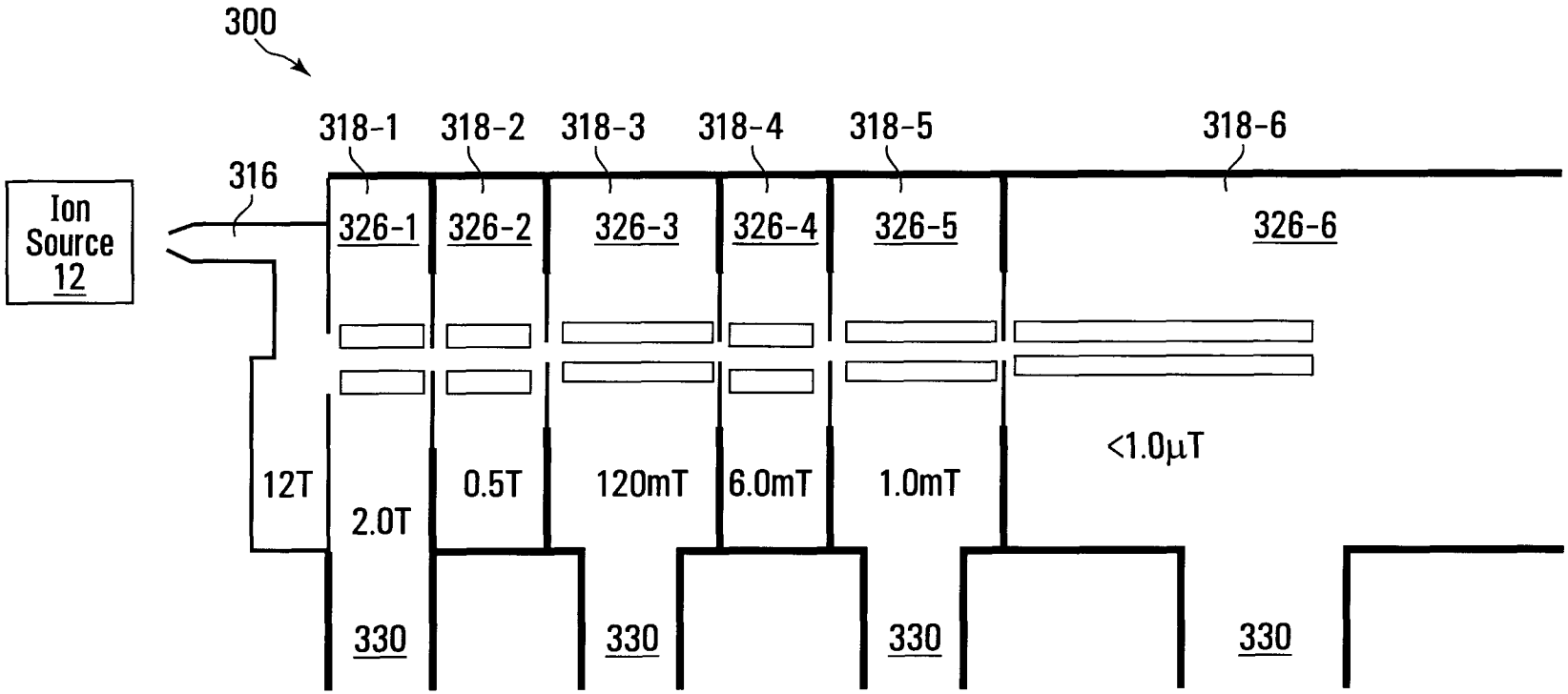
FIG. 7 is a schematic diagram of a mass spectrometer, exemplary of yet a further embodiment of the present invention

FIG. 7 schematically depicts a further mass spectrometer 300, exemplary of an embodiment of the present invention. Mass spectrometer 300 is similar to the mass spectrometer of FIG. 4. Notably, however, one or more pump source(s) 330 are in direct fluid communication with chambers 326-1, 326-3, 326-5, 326-6 of guide stages 318-1, 318-3, 318-5, 318-6, respectively. Pressure in chambers 326-2, and 326-4, as well as ion interface 316 is maintained by pressure within chambers 326-3, 326-5, and chamber 326-1, respectively. Of course, appropriate openings between chambers and to pump source(s) 330 need be provided. In the depicted embodiment, pressure of chamber 326-2 is maintained at 0.5 Torr, while pressure of guide chamber 326-3 is maintained at 120 mTorr. Likewise pressure of chamber 326-4 is maintained at 6.0 mTorr, while pressure of chamber 326-5 is maintained at 1 mTorr. The pressure at the outlet of interface 316 is maintained at 12 Torr, through chamber 326-1, maintained at 2.0 Torr. From interface 316, to chambers 326-1 to 326-6, pressure varies from 12 Torr, to 2.0 Torr, to 0.5 Torr to 120 mTorr, to 6.0 mTorr, to 1.0 mTorr, to less than 1.0 uTorr.

Of course, the above described embodiments are intended to be illustrative only and in no way limiting. The described embodiments of carrying out the invention are susceptible to many modifications of form, arrangement of parts, details and order of operation. For example, the depicted pressures, orifice sizes, pump sizes, number of stages and the like, are only intended to be illustrative. The invention, rather, is intended to encompass all such modification within its scope, as defined by the claims.

What is claimed is:

1. A mass spectrometer, comprising:

a plurality of guide stages for guiding ions between an ion source and an ion detector along a guide axis;

an ion interface for guiding a transport gas and ions entrained therein, said ion interface comprising a casing having a sampling inlet in flow communication with an ion source that ionizes particles of interest and an outlet in communication with a first one of said plurality of guide stages and that slows said transport gas to a generally laminar flow in a laminar flow region;

each of said guide stages contained within one of a plurality of adjacent chambers;

said ion interface and said guide stages defining a continuous flow path from said ion source to said ion detector, for guiding said transport gas and ions entrained therein from said ion source by way of said sampling inlet to said ion detector and wherein said transport gas is provided from said laminar flow region to said guide stages;

at least one pump in flow communication with said plurality of chambers to establish a pressure regime in said plurality of chambers, and along said guide axis in which pressure in each of said plurality of chambers is reduced downstream along said guide axis, and the pressure between said ion interface and a first one of said plurality of chambers differs at a location in said first one of said plurality of chambers by about an order of magnitude, and the pressure at a location in said first one of said plurality of chambers differs from the pressure at a location in a second one of said plurality of chambers by about an order of magnitude, and wherein said pressure regime provides a non-abrupt pressure gradient along said guide axis, to smoothly guide ions entrained in said transport gas along said guide axis from stage to stage of said plurality of guide stages.

2. The mass spectrometer of claim 1, wherein the pressure of the first one of said plurality of chambers differs from the pressure of the second one of said plurality of chambers by less than about 20 fold.

3. The mass spectrometer of claim 1, wherein the pressure of the first one of said plurality of chambers differs from the pressure of the second one of said plurality of chambers by less than about 10 fold.

4. The mass spectrometer of claim 1, wherein the pressure at the outlet of said ion interface and the pressure of the first one of said plurality of chambers differs by less than about 20 fold.

5. The mass spectrometer of claim 1, wherein said at least one pump is in direct flow communication with said first one of said guide stages, and wherein said ion interface comprises a gas inlet and wherein said outlet and said at least one pump are sized to establish a desired pressure in both said first one of said guide stages and in said ion interface.

6. The mass spectrometer of claim 1, wherein two adjacent ones of said plurality of guide stages are interconnected by an opening, and wherein said at least one pump is in direct flow communication with the downstream one of said two adjacent guide stages, and not the upstream one of said two adjacent guide stages, and wherein said opening and said at least one pump are sized to establish a desired pressure in both said two adjacent ones of said guide stages.

7. The mass spectrometer of claim 1, further comprising a sampling cone in at least one of said guide stages.

8. The mass spectrometer of claim 1, comprising four of said chambers, wherein pressure within said four chambers is maintained, respectively, at about at least one Torr; at least several hundred milliTorr; at least one milliTorr; and at least one micro-Torr.

9. The mass spectrometer of claim 1, comprising four of said chambers, wherein pressure within said four chambers is maintained, respectively, at about 10 Torr; 1 Torr; and 200 milliTorr.

10. The mass spectrometer of claim 1, comprising four of said chambers, wherein pressure within said four chambers is maintained, respectively, at about 2 Torr; 200 milliTorr; several milliTorr; and several micro-Torr.

11. The mass spectrometer of claim 1, comprising three of said chambers, wherein pressure within said ion interface, and said three chambers is maintained, respectively, at about at least one Torr; at least several hundred milliTorr; at least one milliTorr; and at least one micro-Torr.

12. The mass spectrometer of claim 1, comprising three of said chambers, wherein pressure within said ion interface, and said three chambers is maintained, respectively, at about 10 Torn 1 Torr; and 200 milliTorr.

13. The mass spectrometer of claim 1, comprising three of said chambers, wherein pressure within said ion interface, and said three chambers is maintained, respectively, at about 2 Torn 200 milliTorr; several milliTorr; and several micro-Torr.

14. The mass spectrometer of claim 1, wherein said at least one pump comprises at least one multi-stage pump.

15. The mass spectrometer of claim 14, wherein said at least one multi-stage pump comprises a turbomolecular pump.

16. The mass spectrometer of claim 1, wherein at least some of said guide stages each comprise a plurality of guide rods arranged about said guide axis to establish a containment field about said guide axis.

17. The mass spectrometer of claim 1, wherein at least some one of said guide stages comprise four guide rods arranged in quadrupole.

18. The mass spectrometer of claim 1, wherein one set of guide rods extend through multiple ones of said guide stages.

19. The mass spectrometer of claim 1, wherein said ion interface comprises a split flow interface, having an ion inlet, said outlet in flow communication with a first one of said guide stages, and an exit in flow communication with a roughing pump.

20. The mass spectrometer of claim 1, wherein said ion interface is a thru-flow interface, and comprises a gas inlet and wherein all gas through said gas inlet passes through said outlet of said ion interface.

21. The mass spectrometer of claim 1, wherein at least one of said plurality of chambers contains at least two sets of guide rods.

22. The mass spectrometer of claim 1, wherein said at least one pump provides a single vacuum and is in flow communication with conductance limiting orifices to multiple of said plurality of chambers, to provide a desired pressure in said plurality of chambers.

23. The mass spectrometer of claim 1, wherein at least some of said chambers comprises at least one conductance limiting orifice in flow communication with said at least one pump, and wherein said at least one conductance limiting orifice is sized to provide a desired pressure within each of said chambers.

24. The mass spectrometer of claim 1, wherein openings connecting adjacent chambers are sized to provide a desired pressure within each of said chambers.

25. The mass spectrometer of claim 1, wherein one of said guide stages comprises one of a collision cell, a mass filter, and a mass resolver.

26. The mass spectrometer of claim 1, wherein the number of said guide stages exceeds the number of said at least one pump.

27. The mass spectrometer of claim 23, wherein the number of said guide stages exceeds the number of said at least one pump.

28. A method guiding ions between an ion source and an ion detector along a guide axis in a mass spectrometer, said method comprising:

providing a plurality of guide stages, each contained within one of a plurality of adjacent chambers arranged about the guide axis, and in flow communication with each other;

providing an ion interface comprising a casing having a sampling inlet in flow communication with an ion source that ionizes particles of interest and an outlet in communication with a first one of said plurality of guide stages, that slows transport gas to a generally laminar flow in a region of generally laminar flow;

said ion interface and said guide stages defining a continuous flow path from said ion source to said ion detector along said guide axis, for guiding said transport gas and ions entrained therein from said ion source by way of said sampling inlet to said ion detector and wherein said transport gas is provided from said region of generally laminar flow to said guide stages;

maintaining each of said plurality of chambers and said ion interface, so that pressure along said guide axis from said ion source to said ion detector is reduced from guide stage to guide stage, and the pressure between said ion interface and a first one of said plurality of chambers at a location in said first one of said plurality of chambers differs by about an order of magnitude, and the pressure at a location in said first one of said plurality of chambers differs from the pressure at a location in a second one of said plurality of chambers by about an order of magnitude, thereby providing a non-abrupt pressure gradient along said guide axis, to smoothly guide ions entrained in said transport gas along said axis from guide stage to guide stage.

29. The method of claim 28, wherein the pressure of the first one of said plurality of chambers differs from the pressure of the second one of said plurality of chambers by about 20 fold.

30. The method of claim 28, wherein the pressure of the first one of said plurality of chambers differs from the pressure of the second one of said plurality of chambers by less than about 10 fold.

31. The method of claim 28, wherein the pressure at the outlet of said ion interface and the pressure of the first one of said plurality of chambers differs by about 20 fold.

32. The method of claim 28, wherein four of said chambers are provided, and said maintaining comprises maintaining pressure within said four chambers, respectively, at about at least one Torr; at least several hundred milliTorr; at least one milliTorr; and at least one micro-Torr.

33. The method of claim 28, wherein four of said chambers are provided, and said maintaining comprises maintaining pressure within said four chambers, respectively, at about 10 Torr; 1 Torr; and 200 milliTorr.

34. The method of claim 28, wherein at least four of said chambers are provided, and said maintaining comprises maintaining pressure within said four chambers, respectively, at about 2 Torr; 200 milliTorr; several milliTorr, and several micro-Torr.

35. The method of claim 28, wherein at least four of said chambers are provided, and said maintaining comprises maintaining pressure within said four chambers, respectively, at about at least one Torr; at least several hundred milliTorr; at least one milliTorr; and at least one micro-Torr.

36. The method of claim 28, wherein at least three of said chambers are provided, and said maintaining comprises maintaining pressure within said ion interface and said three chambers, respectively, at about 10 Torr; 1 Torr; and 200 milliTorr.

37. The method of claim 28, wherein at least three of said chambers are provided, and said maintaining comprises maintaining pressure within said ion interface and said three chambers, respectively, at about 2 Torr; 200 milliTorr; several milliTorr; several micro-Torr.

38. The method of claim 28, further comprising providing a containment field in at least one of said chambers, to contain ions about said axis.

39. The method of claim 38, wherein said containment field is provided by a plurality of guide rods arranged about said guide axis in at least one of said stages.

40. The method of claim 28, wherein said providing a plurality of guide stages comprises providing four of said guide stages, comprising four of said adjacent chambers, and wherein said maintaining comprises maintaining pressure within said four chambers at about at least one Torr; several hundred milliTorr; at least one milliTorr; and at least one micro-Torr, respectively.

41. The method of claim 28, wherein said maintaining comprises providing a pump, and wherein said providing a plurality of guide stages comprises providing at least one conductance limiting orifice in flow communication with said pump and at least one of said chambers, wherein said at least one conductance limiting orifice is sized to provide a desired pressure within said at least one of said chambers.

42. The method of claim 41, wherein the number of said guide stages exceeds the number of said pumps.

43. The method of claim 42, wherein said pump is in direct flow communication with a first one of said guide stages, and wherein said ion interface comprises a gas inlet and wherein said outlet and said pump are sized to establish a desired pressure in both said first one of said guide stages, and in said ion interface.

44. The method of claim 41, wherein two adjacent ones of said plurality of guide stages are interconnected by an opening, and wherein said pump is in direct flow communication with the downstream one of said two adjacent guide stages, and not the upstream one of said two adjacent guide stages, and wherein said opening and said pump are sized to establish a desired pressure in both said two adjacent one of said guide stages.

45. A mass spectrometer, comprising:

a plurality of guide stages for guiding ions between an ion source and an ion detector along a guide axis;

an ion interface having a gas inlet and an outlet providing ions entrained in a transport gas from a region of generally laminar flow of said transport gas;

each of said guide stages contained within one of a plurality of adjacent chambers, wherein pressure in each of said plurality of chambers is gradually reduced downstream along said guide axis;

at least one pump stage, in flow communication with at least one of said plurality of chambers to maintain the pressure therein, said ion interface and said guide stages defining a continuous flow path from said ion source to said ion detector along said guide axis, for guiding said transport gas and ions entrained therein from said ion source by way of said sampling inlet to said ion detector;

wherein ion flow through said ion interface is regulated by said at least one pump stage, through said outlet of said ion interface, and wherein all gas through said gas inlet passes through said outlet of said ion interface; and wherein said transport gas is provided from said region of generally laminar flow to said guide stages thereby providing a non-abrupt pressure gradient along said guide axis, to smoothly guide ions entrained in said transport gas along said guide axis and between said guide stages.

* * * * *